US006000345A

United States Patent [19]

Gillotti

[11] Patent Number: 6,000,345

[45] Date of Patent: Dec. 14, 1999

[54] FOLDING TABLE

[76] Inventor: Michael Gillotti, 6979 Baker La., Sebastopol, Calif. 95472

[21] Appl. No.: 09/016,859

[22] Filed: Jan. 30, 1998

[51] Int. Cl.[6] ..... A47B 3/00

[52] U.S. Cl. ..... 108/36; 108/169; 108/132; 5/620; 297/DIG. 6

[58] Field of Search ..... 108/36, 38, 169, 108/167, 168, 160, 115, 130, 131, 132, 129, 34, 35; 5/620, 114, 111, 724, 655; 297/452.52, 218.1, 218.3, DIG. 6

[56] References Cited

U.S. PATENT DOCUMENTS

| | | | |
|---|---|---|---|
| 4,833,998 | 5/1989 | Everett et al. | 108/36 |
| 4,943,041 | 7/1990 | Romein | 108/36 X |
| 5,009,170 | 4/1991 | Spehar . | |
| 5,402,544 | 4/1995 | Crawford et al. | 5/616 |
| 5,524,555 | 6/1996 | Fanuzzi | 108/132 |
| 5,566,407 | 10/1996 | Lien | 5/655 X |
| 5,718,478 | 2/1998 | Allison | 297/218.1 X |

FOREIGN PATENT DOCUMENTS

| | | | |
|---|---|---|---|
| 1237481 | 6/1960 | France | 108/160 |

OTHER PUBLICATIONS

Golden Ratio Woodworks ad in Winter 1998 issue of Massage Therapy magazine. 1 sheet.

Oakworks ad in Winter 1998 issue of Massage Therapy magazine. 1 sheet.

EarthLite ad in Winter 1998 issue of Massage Therapy magazine. 1 sheet.

*Primary Examiner*—Janet M. Wilkens

*Attorney, Agent, or Firm*—Jack Lo

[57] ABSTRACT

A folding table for supporting a person includes an elongated tabletop comprising a pair of hinged halves. Four legs are pivotally attached to the comers of the tabletop. Four diagonal braces are each connected between the tabletop and a corresponding leg. Each diagonal brace comprises upper and lower members connected by an intermediate pivot. The legs at each end of the table are fixedly connected by a transverse brace. Four diagonal cables are each connected between the tabletop and the intermediate pivot of a corresponding diagonal brace. Four longitudinal cables are each connected between a corresponding intermediate pivot of a corresponding diagonal brace and an opposite leg. The cable arrangement provides improved rigidity and stability, and enables the legs to be folded while the tabletop is in a fully open position, so that the tabletop can be placed flat on the ground for some types of massages. The table can be fully folded by pivoting the two halves together. The tabletop includes a bent tubular metal frame which is very durable and easy to manufacture.

17 Claims, 4 Drawing Sheets

FOLDING TABLE

BACKGROUND OF THE INVENTION

1. Field of the Invention

This invention relates generally to folding massage tables.

2. Prior Art

Massages are becoming increasingly popular for tension reduction and general health. A typical method for performing a massage is to put the client on a table in a prone position. Most massage practitioners often travel to perform massages at different locations, so there is a need for portable folding massage tables.

U.S. pat. No. 5,009,170 to Spehar shows a folding massage table that includes a tabletop comprised of a pair of hinged halves, and two pairs of legs pivotally attached to opposite ends of the tabletop. A diagonal brace is connected between the bottom of the tabletop and each leg. The diagonal brace is comprised of upper and lower sections pivoted about an intermediate hinge. A diagonal cable is connected between the top of each leg and the intermediate hinge of a corresponding diagonal brace, and a horizontal cable is connected between the intermediate hinges of opposite diagonal braces. When the diagonal braces are folded, the intermediate hinges of opposite diagonal braces tend to spread apart from each other if the tabletop is kept fully opened. However, such spreading is prevented by the horizontal cable. Therefore, the tabletop must be simultaneously folded when the legs are folded. As a result, the Sephar table cannot have its legs folded while the tabletop is kept open, so that it cannot be positioned flat on the ground for some types of massages. Further, the horizontal cable is attached to the diagonal braces at a sharp angle, so that it tends to allow some play in the braces, and consequently the rigidity and stability of the table are compromised. Other folding massage tables include products by Golden Ratio Woodworks, Oakworks, and Earthlite, all of which include horizontal cables connecting the intermediate hinges on opposite diagonal braces, and therefore suffer the same disadvantages. All massage tables have tabletops with wooden frames that require labor-intensive fabrication and assembly. Such wooden frames also tend to loosen after prolonged use.

OBJECTS OF THE INVENTION

Accordingly, objects of the present folding table are:

to enable the legs to be folded while the tabletop is in an open position, so that the tabletop can be placed flat on the ground for some types of massages;

to improve rigidity and stability;

to provide a more durable tabletop; and to provide a tabletop which is easier to manufacture.

Further objects of the present invention will become apparent from a consideration of the drawings and ensuing description.

BRIEF SUMMARY OF THE INVENTION

A folding table for supporting a person includes an elongated tabletop comprising a pair of hinged halves. Four legs are pivotally attached to the corners of the tabletop. Four diagonal braces are each connected between the tabletop and a corresponding leg. Each diagonal brace comprises upper and lower members connected by an intermediate pivot. The legs at each end of the table are fixedly connected by a transverse brace. Four diagonal cables are each connected between the tabletop and the intermediate pivot of a corresponding diagonal brace. Four longitudinal cables are each connected between a corresponding intermediate pivot of a corresponding diagonal brace and an opposite leg. The cable arrangement provides improved rigidity and stability, and enables the legs to be folded while the tabletop is in a fully open position, so that the tabletop can be placed flat on the ground for some types of massages. The table can be fully folded by pivoting the two halves together. The tabletop includes a bent tubular metal frame which is very durable and easy to manufacture.

10. Tabletop
11. Longitudinal Sides
12. Opposite Ends
13. Halves
14. Hinges
15. Legs
16. Upper Section
17. Lower Section
18. Knob
19. Diagonal Braces
20. Upper Section
21. Lower Section
22. First Transverse Brace
23. Second Transverse Brace
24. Diagonal Cables
25. Pivot
26. Pivot
27. Longitudinal Cables
28. Handles
29. Latches
30. Mesh
31. Frame
32. Cushion
33. Cover Sheet
34. Hook Fastener
35. Pivot
36. Bottom

DETAILED DESCRIPTION OF THE INVENTION

Figure 1:
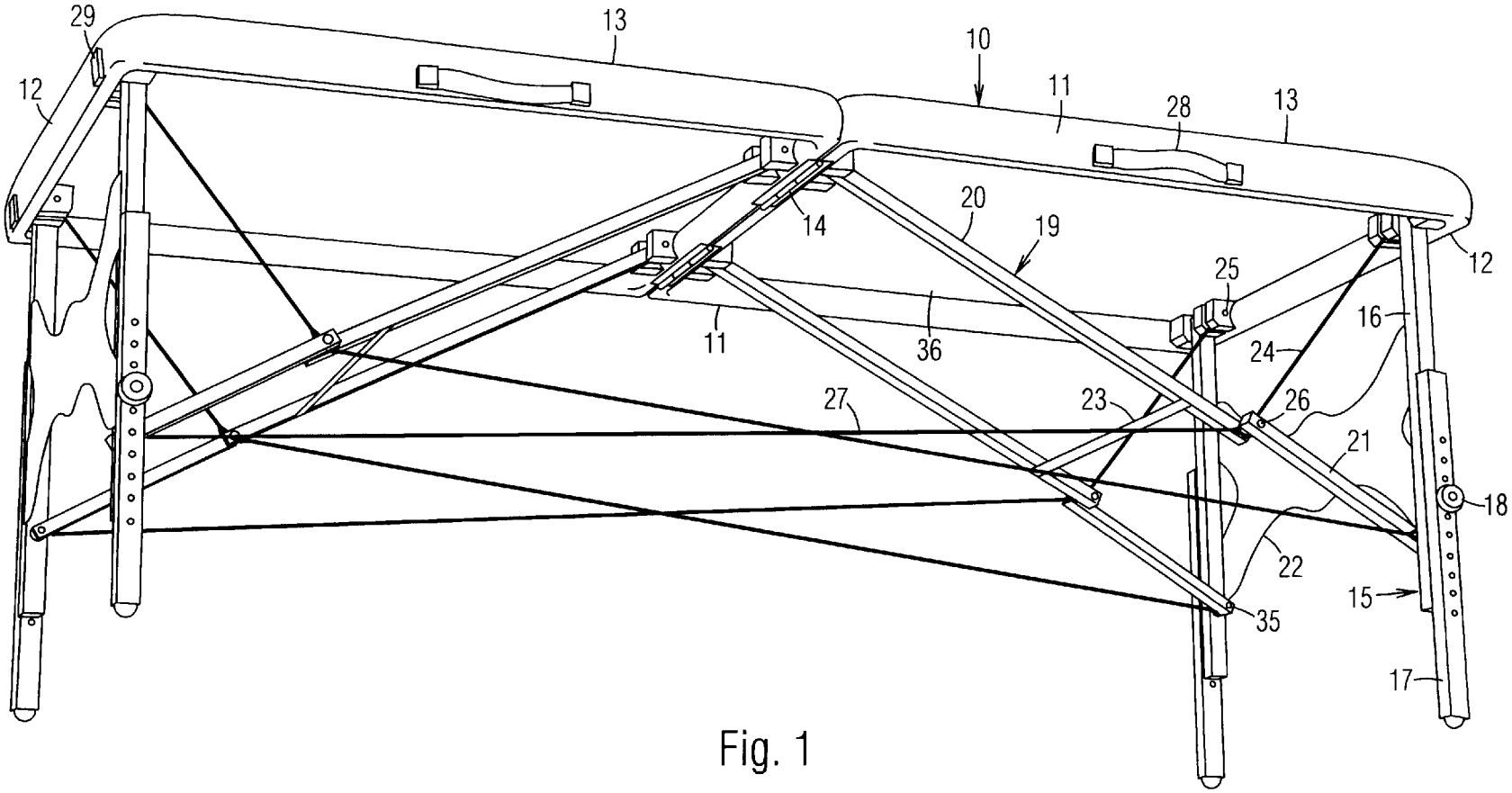
FIG. 1 is a bottom perspective view of the present folding table in an open position.

FIG. 1:

A preferred embodiment of the present folding table is shown in the bottom perspective view in FIG. 1 in an open position. It includes an elongated tabletop 10 with opposite longitudinal sides 11 and opposite ends 12. Tabletop 10 is comprised of two halves 13 hinged about a transverse axis by hinges 14. Four legs 15 are provided. Two legs 15 are pivotally attached to a bottom 36 of tabletop 10 at each opposite end 12 along opposite longitudinal sides 11. Legs 15 are each comprised of a pair of overlapping members 16 and 17 that are adjustably attached together by a knob 18 for changing the height of tabletop 10. Four diagonal braces 19 are connected to respective legs 15. Each diagonal brace 19 has an upper end hinged to bottom 36 of tabletop 10 adjacent an inner end of a half 13, and a lower end hinged to a corresponding leg 15. Each diagonal brace 19 is comprised of an upper section 20 and a lower section 21 hinged together at their inner ends by an intermediate pivot 26. Legs 15 at each opposite end 12 are fixedly connected by a first transverse brace 22, so that they pivot together. Upper sections 20 of adjacent diagonal braces 19 at the sarrie half of tabletop 10 are fixedly connected by a second transverse brace 23, so that they pivot together.

Four flexible but non-stretchable diagonal cables 24 are provided. Each diagonal cable 24 has a top end pivotally connected to a pivot 25 at the top end of a corresponding leg 15, and a bottom end pivotally connected to intermediate pivot 26 of a corresponding diagonal brace 19. Four flexible but non-stretchable longitudinal cables 27 are provided. Each longitudinal cable 27 has one end pivotally connected to intermediate pivot 26 of a corresponding diagonal brace 19, and an opposite end pivotally connected to an opposite leg 15, preferably at a lower pivot 35 where opposite leg 15 is connected to the lower end of an opposite diagonal brace 19. Longitudinal cables 27 are preferably connected to legs 15 at generally right angles, so that play in legs 15 is minimized, and the rigidity and stability of the table are maximized. Handles 28 are attached to the sides of halves 13, and a pair of latches 29 is attached to an end 12 of tabletop 10.

FIGS. 2–4

Figure 2:
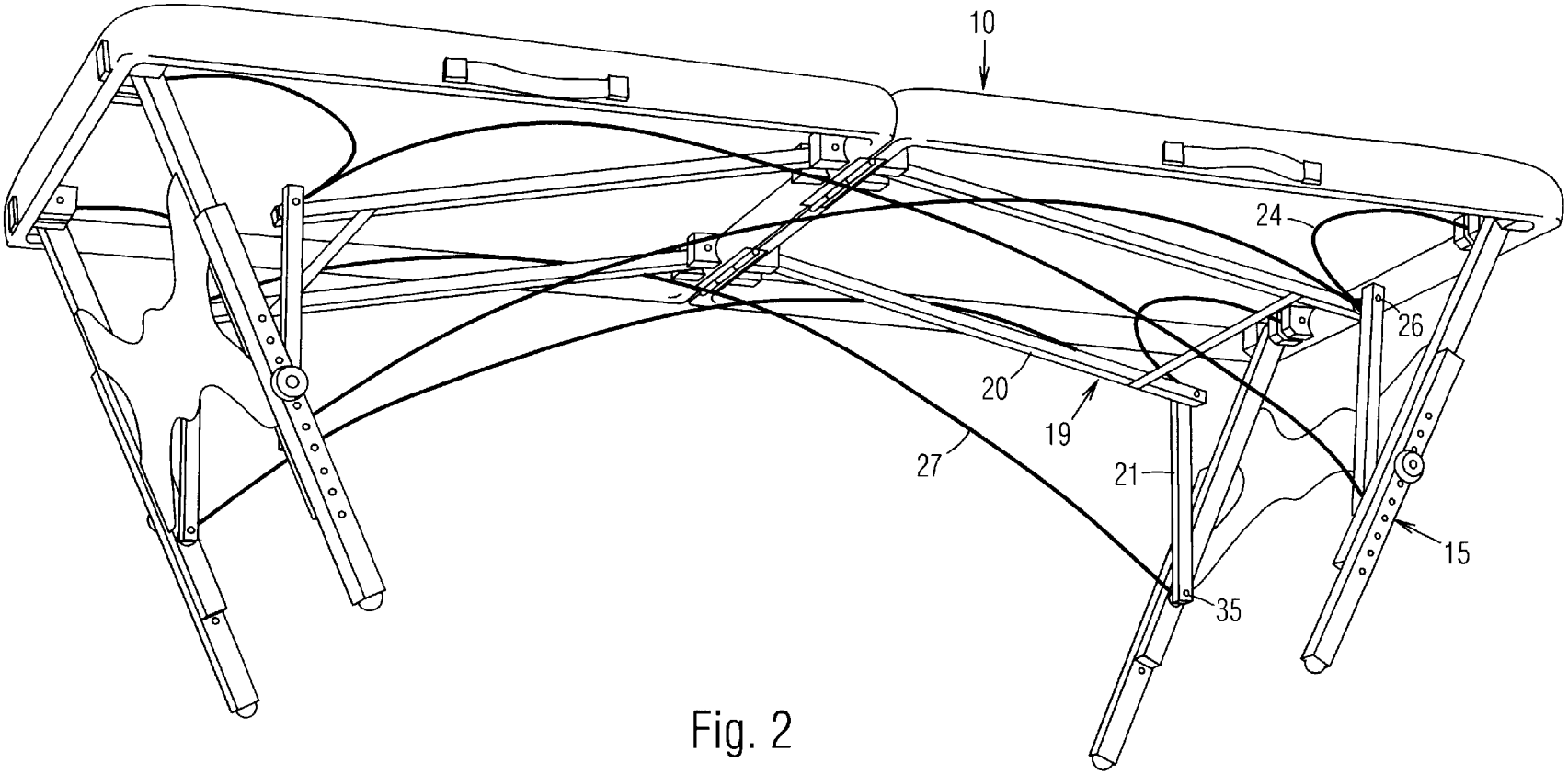
FIG. 2 is a bottom perspective view of the folding table when the legs are being folded.
Figure 3:
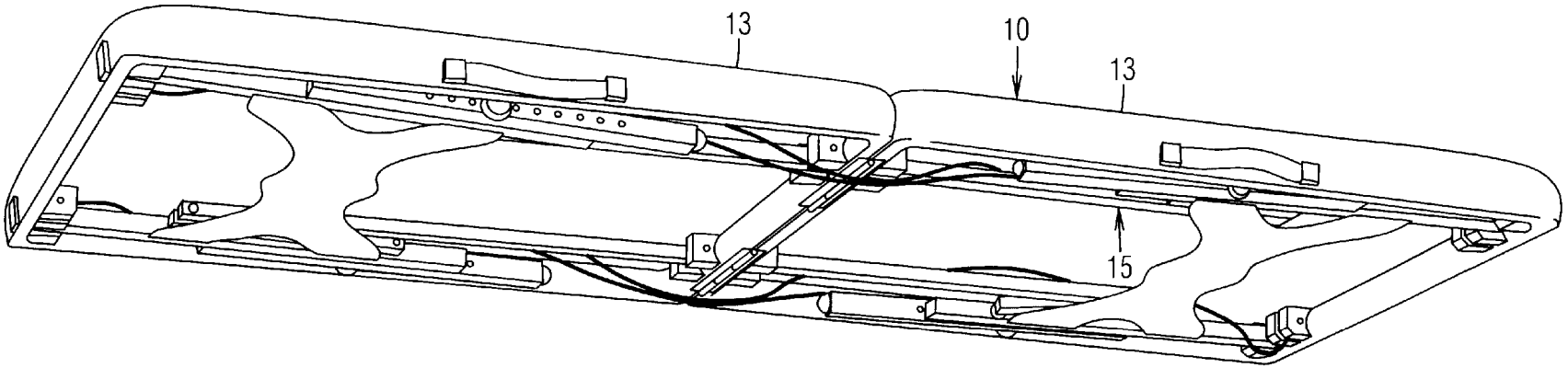
FIG. 3 is a bottom perspective view of the folding table when the legs are completely folded.
Figure 4:
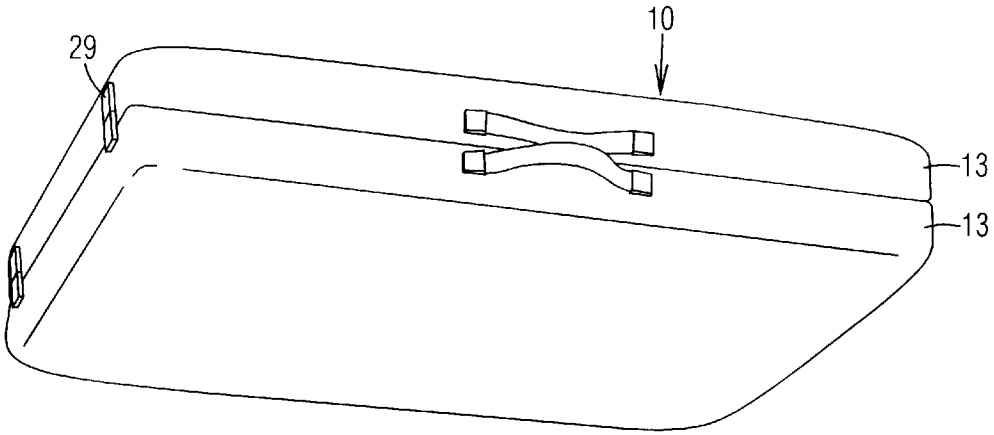
FIG. 4 is a bottom perspective view of the folding table in a fully compacted position.

As shown in the bottom perspective view in FIG. 2, the table is compacted by folding sections 20 and 21 of diagonal braces 19 toward tabletop 10, and pivoting legs 15 inwardly toward tabletop 10. The ends of each longitudinal cable 27 are moved closer together as legs 15 are folded. This enables legs 15 to be folded while tabletop 10 is kept in a fully open position. As shown in FIG. 3, legs 15 are fully retracted under tabletop 10, which can be placed flat on the ground for some types of massages. To close the table completely, halves 13 are folded toward each other and locked together with latches 29, as shown in FIG. 4.

Figure 5:
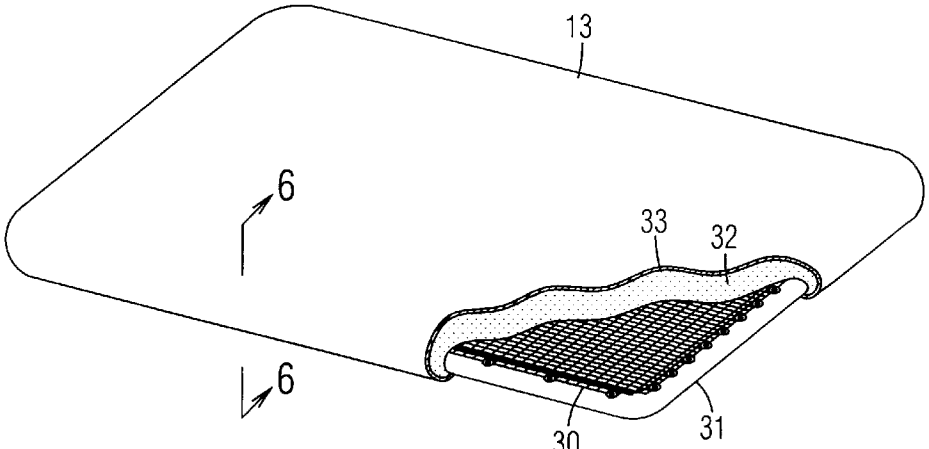
FIG. 5 is a partial cutaway top perspective view of a tabletop half.
Figure 6:
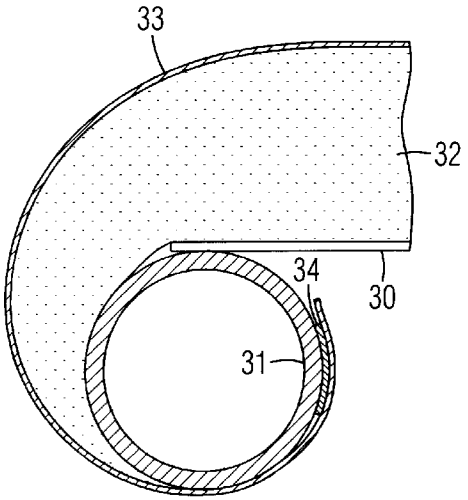
FIG. 6 is a sectional view of the tabletop half taken along line 6—6 in FIG. 5.

FIGS. 5–6:

A tabletop half 13 is shown in a top perspective partial cutaway view in FIG. 5. It includes a wire mesh 30 attached across the top of an. opening of a tubular metal frame 31, which is formed by bending a single metal tube and welded at the abutting ends to form a closed path. Frame 31 is much easier to manufacture than prior art wooden frames, and is much more durable. A cushion 32 is positioned on mesh 30, and a cover sheet 33 is stretched over cushion 32. As shown in the sectional view in FIG. 6, a plurality of hook fasteners 34 (one shown), i.e., the hook portions of hook-and-loop fasteners, are adhered or otherwise attached around the inside of frame 31. The edge of cover sheet 33, which includes a fuzzy inner side resembling the hook portion of a hook-and-loop fastener, is attached to hook fasteners 34. Cover sheet 33 is thus easily attached without staples, and can also be easily replaced. Wire mesh 30 provides resilient but durable support.

SUMMARY AND SCOPE

Accordingly, an improved folding table is provided. Its cables are arranged so that its legs can be folded while the tabletop is in a fully open position, so that the tabletop can be placed flat on the ground for some types of massages. The cables are arranged for increased rigidity and stability. Also, the frame of the tabletop is durable and easy to manufacture.

Although the above description is specific, it should not be considered as a limitation on the scope of the invention, but only as an example of the preferred embodiment. Many substitutes and variations are possible within the teachings of the invention. For example, the cables can be replaced with rigid telescoping members. Therefore, the scope of the invention should be determined by the appended claims and their legal equivalents, not by the examples given.

I claim:

1. A folding table, comprising:

an elongated tabletop with opposite longitudinal sides and opposite ends, said tabletop comprising two halves hinged about a transverse axis;

four legs, top ends of two of said legs are pivotally attached to a bottom of said tabletop at each of said opposite ends along said opposite longitudinal sides;

four diagonal braces each having a lower end hinged to a corresponding one of said legs, and an upper end hinged to a corresponding one of said halves of said tabletop, each of said diagonal braces comprising an upper section and a lower section hinged together by an intermediate pivot; and four longitudinal cables each having one end connected to said intermediate pivot of a corresponding one of said diagonal braces, and an opposite end connected to an opposite one of said legs, said longitudinal cables stabilizing said folding table when said tabletop is in an open position and said legs are extended, said longitudinal cables enabling said legs to be folded under said tabletop when said tabletop is maintained in said open position.

2. The folding table of claim 1, wherein said legs at each of said opposite ends of said tabletop are fixedly connected by a transverse brace.

3. The folding table of claim 1, wherein said legs are each comprised of a pair of overlapping members that are adjustably attached together for changing a height of said tabletop.

4. The folding table of claim 1, wherein when the legs are extended, each of said longitudinal cables is connected to a corresponding one of said legs at a generally right angle, so that play in said legs is minimized, and rigidity and stability of said folding table are maximized.

5. The folding table of claim 1, wherein each of said halves of said tabletop is comprised of a tubular frame, a mesh extending across said frame, a cushion on top of said mesh, and a cover sheet covering said cushion.

6. The folding table of claim 1, wherein each of said halves of said tabletop is comprised of a frame, a mesh extending across said frame, a cushion on top of said mesh, and a cover sheet covering said cushion, a perimeter of said cover sheet being secured around said frame by a plurality of hook fasteners attached around said frame.

7. A folding table, comprising:

an elongated tabletop with opposite longitudinal sides and opposite ends, said tabletop comprising two halves hinged about a transverse axis;

four legs, top ends of two of said legs are pivotally attached to a bottom of said tabletop at each of said opposite ends along said opposite longitudinal sides;

four diagonal braces each having a lower end hinged to a corresponding one of said legs, and an upper end hinged to a corresponding one of said halves of said tabletop, each of said diagonal braces comprising an upper section and a lower section hinged together by an intermediate pivot;

four diagonal cables each having an upper end connected to said tabletop adjacent a corresponding one of said legs, and a lower end connected to an intermediate portion of a corresponding one of said diagonal braces; and four longitudinal cables each having one end connected to said intermediate portion of a corresponding one of said diagonal braces, and an opposite end connected to an opposite one of said legs, said longitudinal cables stabilizing said folding table when said tabletop is in an open position and said legs are extended, said longitudinal cables enabling said legs to be folded under said tabletop when said tabletop is maintained in said open position.

8. The folding table of claim 7, wherein said legs at each of said opposite ends of said tabletop are fixedly connected by a transverse brace.

9. The folding table of claim 7, wherein said legs are each comprised of a pair of overlapping members that are adjustably attached together for changing a height of said tabletop.

10. The folding table of claim 7, wherein when the legs are extended, each of said longitudinal cables is connected to a corresponding one of said legs at a generally right angle, so that play in said legs is minimized, and the rigidity arid stability of said folding table are maximized.

11. The folding table of claim 7, wherein each of said halves of said tabletop is comprised of a tubular frame, a mesh extending across said frame, a cushion on top of said mesh, and a cover sheet covering said cushion.

12. The folding table of claim 7, wherein each of said halves of said tabletop is comprised of a frame, a mesh extending across said frame, a cushion on top of said mesh, and a cover sheet covering said cushion, a perimeter of said cover sheet being secured around said frame by a plurality of hook fasteners attached around said frame.

13. A folding table, comprising:

an elongated tabletop with opposite longitudinal sides and opposite ends, said tabletop comprising two halves hinged about a transverse axis;

four legs, top ends of two of said legs are pivotally attached to a bottom of said tabletop at each of said opposite ends along said opposite longitudinal sides;

four diagonal braces each having a lower end hinged to a corresponding one of said legs, and an upper end hinged to a corresponding one of said halves of said tabletop, each of said diagonal braces comprising an upper section and a lower section hinged together by an intermediate pivot;

four diagonal cables each having an upper end connected to said tabletop adjacent a corresponding one of said legs, and a lower end connected said intermediate pivot of a corresponding one of said diagonal braces; and four longitudinal cables each having one end connected to said intermediate pivot of a corresponding one of said diagonal braces, and an opposite end connected to said lower end of an opposite one of said diagonal braces, said longitudinal cables stabilizing said folding table when said tabletop is in an open position and said legs are extended, said longitudinal cables enabling said legs to be folded under said tabletop when said tabletop is maintained in said open position.

14. The folding table of claim 13, wherein said legs at each of said opposite ends of said tabletop are fixedly connected by a transverse brace.

15. The folding table of claim 13, wherein said legs are each comprised of a pair of overlapping members that are adjustably attached together for changing a height of said tabletop.

16. The folding table of claim 13, wherein each of said halves of said tabletop is comprised of a tubular frame, a mesh extending across said frame, a cushion on top of said mesh, and a cover sheet covering said cushion.

17. The folding table of claim 13, wherein each of said halves of said tabletop is comprised of a frame, a mesh extending across said frame, a cushion on top of said mesh, and a cover sheet covering said cushion, a perimeter of said cover sheet being secured around said frame by a plurality of hook fasteners attached around said frame.

* * * * *